US007461680B2

(12) United States Patent
Cortigiano, Sr.

(10) Patent No.: US 7,461,680 B2
(45) Date of Patent: Dec. 9, 2008

(54) APPARATUS FOR REPEATEDLY ADVANCING FASTENER TAPE A PREDETERMINED DISTANCE

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 479 days.

(21) Appl. No.: 11/081,369

(22) Filed: Mar. 16, 2005

(65) Prior Publication Data

US 2006/0207727 A1 Sep. 21, 2006

(51) Int. Cl.
*B32B 41/00* (2006.01)

(52) U.S. Cl. ..... 156/356; 156/361; 156/362; 156/367; 156/368

(58) Field of Classification Search ..... 156/358, 156/361, 362, 367, 368; 493/29, 115, 213, 493/390, 923, 927, 963; 53/412, 420, 139.2
See application file for complete search history.

(56) References Cited

U.S. PATENT DOCUMENTS 5,478,001 A 12/1995 Pillsbury et al.
6,347,885 B1 * 2/2002 Buchman ..... 383/5
6,662,843 B1 12/2003 Johnson
2004/0020035 A1 * 2/2004 Cortigiano, Sr. ..... 29/768

FOREIGN PATENT DOCUMENTS

DE 4127779 A1 3/1992
EP 0990612 A 4/2000

* cited by examiner

*Primary Examiner*—George R Koch, III
(74) *Attorney, Agent, or Firm*—Ostrager Chong Flaherty & Broitman P.C.

(57) ABSTRACT

A system for accurately and repeatedly pulling a length of plastic fastener tape a predetermined distance. The system comprises an indexing gripper assembly and a stationary gripper assembly, the latter being disposed downstream of the former. The indexing gripper assembly is carried on a carriage that travels back and forth on a linear rail. The rotation of a lead screw is converted into linear displacement of the carriage, the lead screw being driven by a servomotor. While the stationary gripper is open, the indexing gripper grips the fastener tape; then the indexing gripper is advanced a predetermined distance, pulling the fastener tape with it. The stationary gripper is then actuated to grip the fastener tape, following which the indexing gripper is opened and returned to its home position.

8 Claims, 5 Drawing Sheets

APPARATUS FOR REPEATEDLY ADVANCING FASTENER TAPE A PREDETERMINED DISTANCE

BACKGROUND OF THE INVENTION

The present invention generally relates to apparatus for automatically advancing a length of plastic fastener tape used in reclosable packaging by a predetermined distance.

During the automated manufacture of reclosable bags, successive sections of a continuous length of thermoplastic fastener tape unwound from a supply reel or spool are joined (e.g., by conductive heat sealing) to successive sections of a continuous web of bag making material (e.g., a monolayer of thermoplastic film or a laminate comprising a layer of thermoplastic film). The web-to-fastener tape sealing operation can be performed either intermittently or continuously. Often the fastener tape has sliders inserted thereon, one slider per section, before that section is joined to the bag making material. In the latter event, it is also customary to form one slider end stop structure per section of the fastener tape prior to the latter being joined to the bag making material.

When the fastener tape carries a repeating structural feature (e.g., a slider or slider end stop structure), it is important that that those structural features be accurately placed at regular intervals to ensure that the structural features and the respective pockets or receptacles of the packages or bags are in proper registration. In particular, each slider end stop structure must be correctly aligned with a respective cross seal formed on the package or bag.

There is a continuing need for improvements in automated equipment for ensuring correct registration of slider-carrying fastener tape with precursor packages or bags on a packaging or bag making machine.

BRIEF DESCRIPTION OF THE INVENTION

The present invention is directed to a machine for repeatedly advancing a length of extruded plastic fastener tape a predetermined distance. In the disclosed embodiments, the starting fastener tape comprises a pair of extruded flanged zipper strips having mutually interlockable closure profiles. In accordance with various embodiments, the fastener tape may be advanced through various fastener processing stations, such as a slider insertion station or an ultrasonic welding station, and toward a take-up roll or toward a fastener application station of a packaging machine, bag machine, form-fill-seal machine, or other similar types of machinery.

One aspect of the invention is an apparatus comprising: a fixed support frame comprising a straight rail; an indexing gripper assembly that is slidably mounted to the rail for linear motion therealong; a stationary gripper assembly that is mounted to the support frame; an indexing drive mechanism for moving the indexing gripper assembly linearly between first and second positions along the rail, the second position being closer to the stationary gripper assembly than the first position is; and a controller programmed to control the indexing and stationary gripper assemblies and the indexing drive mechanism so that the following events occur in the order listed: (a) the indexing gripper assembly is actuated to grip a first section of a length of fastener tape that is substantially straight while the indexing gripper assembly is in the first position; (b) while the indexing gripper assembly is gripping the first section and the stationary gripper assembly is not gripping any section of the length of fastener tape, the indexing drive mechanism is actuated to move the indexing gripper assembly from the first to the second position; (c) while the indexing gripper assembly is in the second position and is gripping the first section of the length of fastener tape, the stationary gripper assembly is actuated to grip a second section of the length of fastener tape that is disposed ahead of the first section; (d) while the stationary gripper assembly is gripping the second section of the length of fastener tape and the indexing gripper assembly is in the second position, the indexing gripper assembly is actuated to release the first section of the length of fastener tape; and (e) while the stationary gripper assembly is gripping the second section and the indexing gripper assembly is not gripping any section of the length of fastener tape, the indexing drive mechanism is actuated to move the indexing gripper assembly from the second to the first position.

Another aspect of the invention is a machine comprising: a first gripper assembly that is movable along a straight line; a second gripper assembly that is stationary during machine operation; means for moving the first gripper assembly between first and second positions along the straight line, the second position being closer to the second gripper assembly than the first position is; and a controller programmed to control the first and second gripper assemblies and the moving means so that the following events occur in the order listed: (a) the first gripper assembly is actuated to grip a first section of a length of fastener tape that is substantially straight while the first gripper assembly is in the first position; (b) while the first gripper assembly is gripping the first section and the second gripper assembly is not gripping any section of the length of fastener tape, the moving means are actuated to move the first gripper assembly from the first to the second position; (c) while the first gripper assembly is in the second position and is gripping the first section of the length of fastener tape, the second gripper assembly is actuated to grip a second section of the length of fastener tape that is disposed ahead of the first section; (d) while the second gripper assembly is gripping the second section of the length of fastener tape and the first gripper assembly is in the second position, the first gripper assembly is actuated to release the first section of the length of fastener tape; and (e) while the second gripper assembly is gripping the second section and the first gripper assembly is not gripping any section of the length of fastener tape, the means are actuated to move the first gripper assembly from the second to the first position.

A further aspect of the invention is a machine for processing a length of fastener tape made of plastic material, comprising: a fixed support frame comprising a straight rail; a first gripper assembly that is slidably mounted to the rail for linear motion therealong, the first gripper assembly comprising a pair of mutually opposing grippers, the fastener tape passing between the grippers of the first gripper assembly; a second gripper assembly that is stationarily mounted to the support frame, the second gripper assembly comprising a pair of mutually opposing grippers, the fastener tape passing between the grippers of the second gripper assembly; an indexing drive mechanism mounted to the support frame for moving the first gripper assembly linearly between first and second positions along the rail, the second position being closer to the stationary gripper assembly than the first position is; a slider insertion device mounted to the support frame, the slider device comprising a pusher that, when extended, moves toward the fastener tape; and a controller programmed for controlling the first and second gripper assemblies, the indexing drive mechanism, and the slider insertion device so that the following events occur: (a) while the second gripper assembly is open, the first gripper assembly is closed and then displaced along the rail from a home position to an away position closer to the second gripper assembly, the grippers of the first gripper assembly gripping a first section of the length of fastener tape; (b) while the first gripper assembly is in the away position, the second gripper assembly is closed and then the first gripper assembly is opened, the grippers of the second gripper assembly gripping a second section of the length of fastener tape; and (c) while the second gripper assembly is closed, the first gripper assembly returns to the home position and the pusher of the slider insertion device pushes a slider onto a third section of the length of fastener tape.

Yet another aspect of the invention is a machine for processing a length of fastener tape made of plastic material, comprising: a fixed support frame comprising a straight rail; a first gripper assembly that is slidably mounted to the rail for linear motion therealong, the first gripper assembly comprising a pair of mutually opposing grippers, the fastener tape passing between the grippers of the first gripper assembly; a second gripper assembly that is stationarily mounted to the support frame, the second gripper assembly comprising a pair of mutually opposing grippers, the fastener tape passing between the grippers of the second gripper assembly; an indexing drive mechanism mounted to the support frame for moving the first gripper assembly linearly between first and second positions along the rail, the second position being closer to the stationary gripper assembly than the first position is; a shaping device a slider insertion device mounted to the support frame, the shaping device comprising a component that, when extended, moves toward the fastener tape, the shaping device being capable of shaping or otherwise deforming the fastener tape; and a controller programmed for controlling the first and second gripper assemblies, the indexing drive mechanism, and the shaping device so that the following events occur: (a) while the second gripper assembly is open, the first gripper assembly is closed and then displaced along the rail from a home position to an away position closer to the second gripper assembly, the grippers of the first gripper assembly gripping a first section of the length of fastener tape; (b) while the first gripper assembly is in the away position, the second gripper assembly is closed and then the first gripper assembly is opened, the grippers of the second gripper assembly gripping a second section of the length of fastener tape; and (c) while the second gripper assembly is closed, the first gripper assembly returns to the home position and the shaping device shapes or otherwise deforms a third section of the length of fastener tape.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
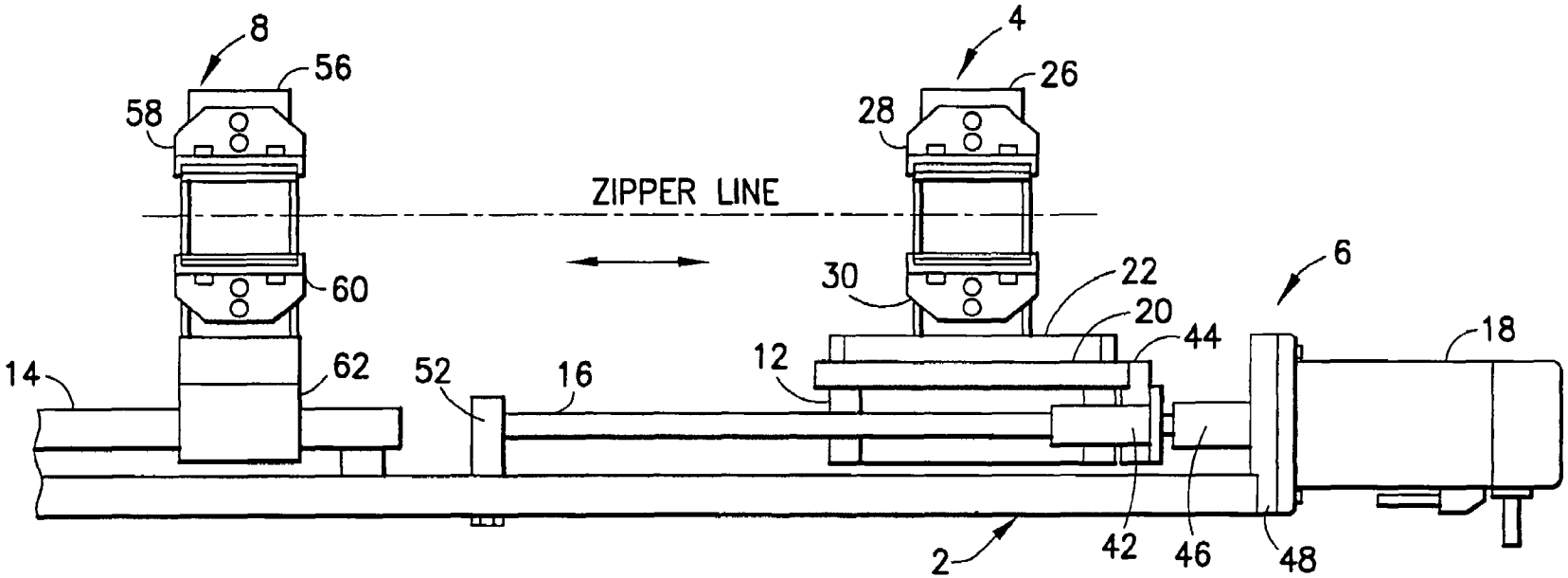
FIG. 1 is a drawing showing a front view of a fastener tape advancement apparatus comprising an indexing gripper assembly and a stationary gripper assembly in accordance with one embodiment of the invention. The dash-dot line represents the path along which a length of straight plastic fastener (e.g., zipper) tape will be pulled by the apparatus.

An apparatus for repeatedly advancing a length of straight fastener tape by a predetermined distance in accordance with one embodiment of the invention is depicted in FIG. 1. The fastener tape advancing apparatus is mounted to a support frame, portions of which are shown in FIG. 1. The fastener tape advancing apparatus comprises an indexing gripper assembly 4 that is linearly displaced (left and right in FIG. 1, as indicated by the double-headed arrow) by an indexing drive mechanism (generally designated by the numeral 6), and a gripper assembly 8 that is stationary during machine operation. As will be explained in greater detail with reference to FIGS. 2-4, the support frame comprises a support plate 2 and a pair of straight rails (parallel to each other, but at different stations along the production line). The indexing gripper assembly 4 comprises a carriage 12 that rides on the first straight rail (not shown in FIG. 1, but see item 10 in FIGS. 2 and 4), an adapter plate 20 fastened to the carriage 12, and a mounting plate 22 fastened to the adapter plate 20. The gripper assembly 8 comprises a carriage 62 that is slidable along the second straight rail 14 to allow adjustment of the longitudinal position of the gripper assembly 8. But once the adjustment has been made, the gripper assembly 8 is secured relative to the rail 14, e.g., by means of a thumbscrew, so that the gripper assembly 8 is stationary during machine operation.

Figures 2, 3:
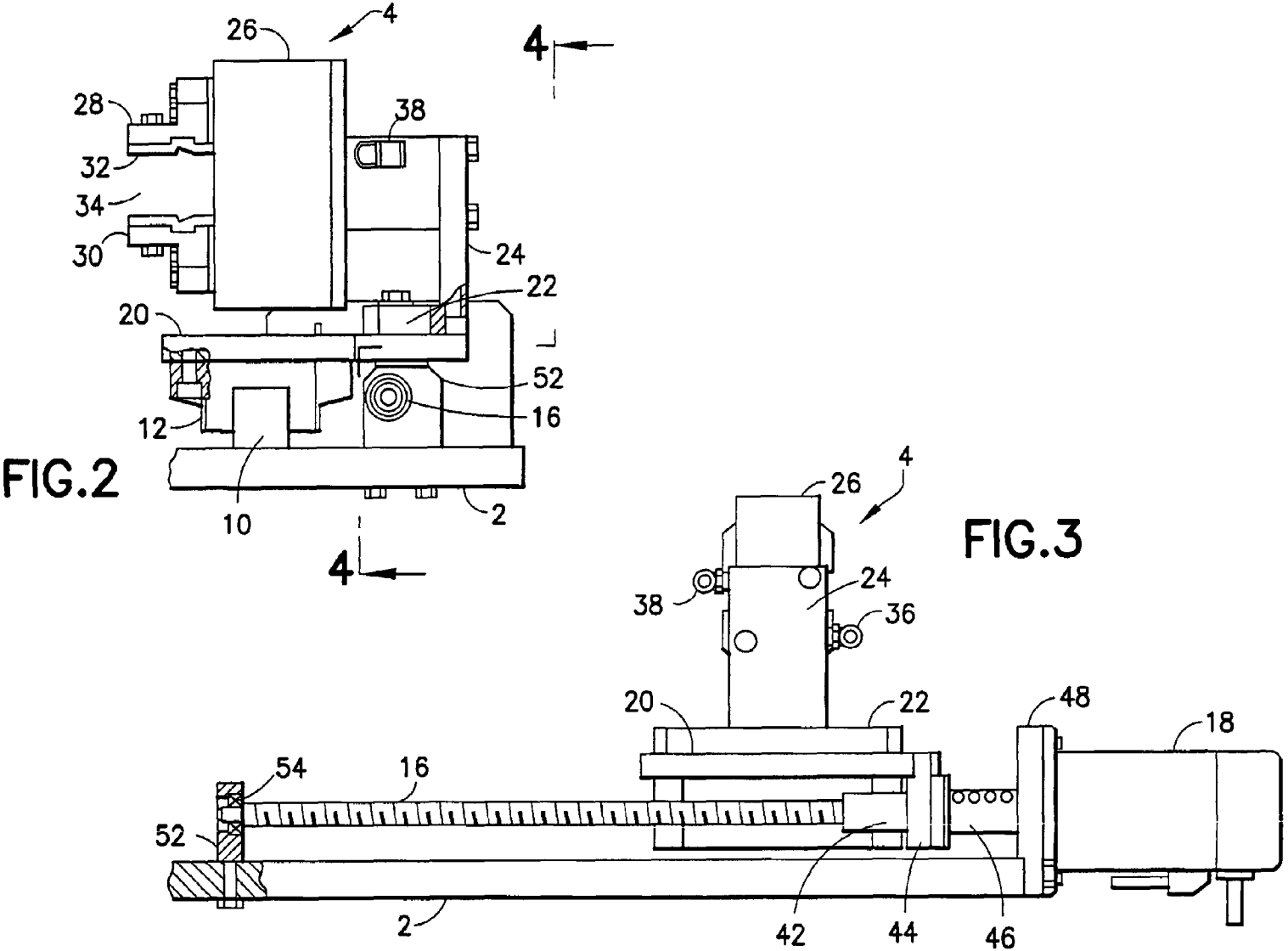
FIGS. 2 and 3 are drawings showing end and rear views, respectively, of part of an apparatus (including the indexing but not the stationary gripper assembly) which is the mirror image of the apparatus depicted in FIG. 1. In both FIGS. 1 and 3, the indexing gripper assembly pulls fastener tape leftward.

As best seen in FIG. 3, the indexing drive mechanism 6 comprises a lead screw 16 driven to rotate by a servomotor 18. The indexing gripper assembly 4 further comprises a nut 42 threadably coupled to the lead screw 16. The nut 42 is rigidly connected to adapter plate 20 by means of a nut mount 44. The nut 42 converts the rotation of the lead screw 16 into linear displacement of the carriage 12. The servomotor is mounted to the support plate 2 by means of a motor mounting plate 48. The lead screw 16 is coupled to an output shaft of the servomotor by means of a coupling 46. A distal end of lead screw 16 is rotatably supported by bearings (item 54 in FIG. 3) installed in a lead screw mount 52.

Each of the gripper assemblies 4 and 8 comprises a respective pair of gripper arms that are linked to move equal distances in opposite directions. As seen in FIG. 1, the indexing gripper assembly 4 comprises a pair of oppositely moving gripper arms 28 and 30. When the gripper assembly 4 is in a closed state, respective gripper pads on the gripper arms 28 and 30 grip a first section of a length of straight fastener tape having a centerline generally collinear with the dash-dot line in FIG. 1. The gripper arms 28 and 30 are actuated by a double-acting parallel motion air cylinder 26 (partly hidden behind gripper arms 28 and 30 in FIG. 1).

Similarly, the stationary gripper assembly 8 comprises a pair of oppositely moving gripper arms 58 and 60. When the gripper assembly 8 is in a closed state, respective gripper pads on the gripper arms 58 and 60 grip a second section of the length of straight fastener tape, the second section being disposed ahead or forward of the first section. The gripper arms 58 and 60 are actuated by a double-acting parallel motion air cylinder 56 (partly hidden behind gripper arms 58 and 60 in FIG. 1).

Each of the parallel motion cylinders 26 and 56 houses a respective piston that can be moved in one direction by supplying compressed air to one of two intake ports on the cylinder (e.g., one of ports 36 and 38 of air cylinder 26, as seen in FIG. 3) and can be moved in the opposite direction by supplying compressed air to the other of the two intake ports on the cylinder (e.g., the other of ports 36 and 38 of air cylinder 26, as seen in FIG. 3). The piston of each parallel motion cylinder has respective racks formed thereon which are respectively mechanically linked to the gripper arms of the particular gripper assembly (e.g., gripper arms 28 and 30 of the indexing gripper assembly 4, seen in FIG. 2) by respective pinions (not shown).

Figure 4:
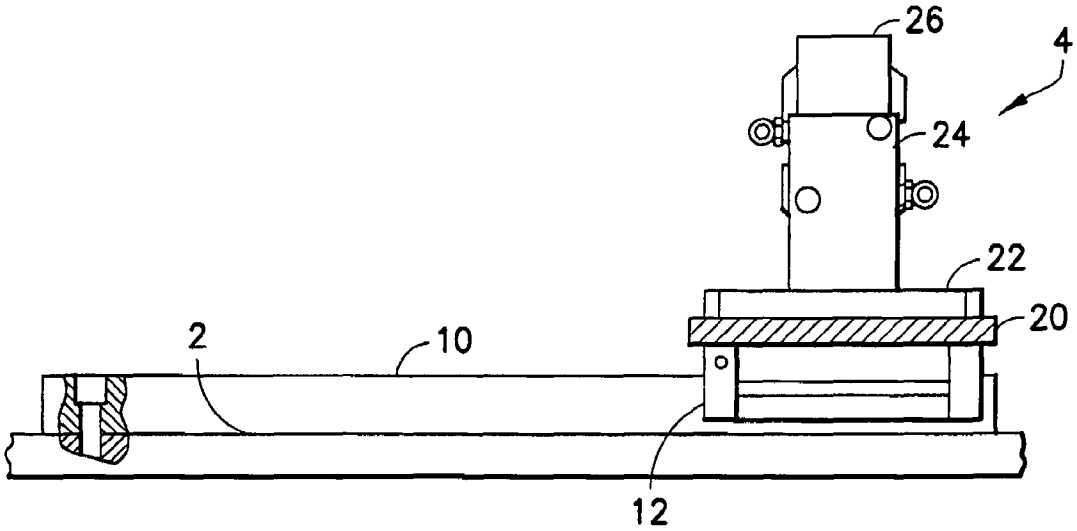
FIG. 4 is a drawing showing a sectional view of the apparatus depicted in FIGS. 2 and 3, taken along the section line 4-4 appearing in FIG. 2.

Each parallel motion cylinder is mounted to a respective carriage by means of a rigid support structure. As seen in FIG. 2, the parallel motion cylinder 26 is fastened to a vertical cylinder mounting plate 24, which is in turn fastened to the horizontal mounting plate 22. As previously described, the latter plate is fastened to the adapter plate 20, which is in turn fastened to the carriage 12. As seen in FIG. 2, the carriage 12 has an inverted U shape and rides on the straight rail 10 by means of bearings (not shown). The home position of the carriage 12 on rail 10 is depicted in FIG. 4. The parallel motion cylinder 56 of the stationary gripper assembly 8 depicted in FIG. 1 may be mounted to the carriage 62 by a support structure comprising vertical cylinder mounting plate and a horizontal mounting plate, similar to mounting plates 24 and 22 previously described.

FIG. 1 shows the fastener tape advancement apparatus in a state wherein both gripping assemblies 4 and 8 are open and the indexing gripper assembly 4 is located at its home position, i.e., the position closest to the servomotor 18. This state would not normally occur during operation of the apparatus. More specifically, at all times at least one of the two gripper assemblies 4 and 8 is gripping the length of fastener tape, as explained in detail below.

As previously described, the apparatus depicted in FIG. 1 has three actuators: air cylinders 26 and 56 and servomotor 18. Operation of these actuators is coordinated and synchronized by a programmable logic controller (PLC). The PLC is programmed to cause the following events (none of which have occurred yet in the apparatus depicted in FIG. 1) to occur during each work cycle.

At the start of the work cycle, the controller causes a double-acting parallel motion air cylinder 26 to extend its piston rod (not shown in the drawings), e.g., by activating a solenoid that, in turn, actuates a valve that connects one of the ports 36 and 38 (seen in FIG. 3) of air cylinder 26 to a source of compressed air whose state is controlled by the controller. The piston rod has respective racks formed thereon which are respectively mechanically linked to the gripper arms 28 and 30 of the indexing gripper assembly 4 by respective pinions (not shown in the drawings). This occurs while the indexing gripper assembly 4 is in a home position, i.e., the position closest to the servomotor 18 as seen in FIG. 3. Extending the piston rod causes the gripper arms 28 and 30 to move toward each other until the gripper pads 32 and 34 (shown fully separated in FIG. 2) grip a first section of the length of straight fastener tape. This occurs while the stationary gripper assembly 8 (shown in FIG. 1 only) is already gripping a second section of the length of fastener tape (which gripping was actuated during the previous work cycle).

In the next phase of the work cycle, the controller causes a double-acting air cylinder 56 (see FIG. 1) of the stationary gripper assembly 8 to retract its piston rod (not shown in the drawings), again, e.g., by activating a solenoid that, in turn, actuates a valve that connects one of two ports of air cylinder 56 to a source of compressed air. The air cylinder 56 has the same structure and operation as the air cylinder 26, i.e., its piston rod has respective racks formed thereon which are respectively mechanically linked to the gripper arms 58 and 60 by respective pinions (not shown in the drawings). Retracting the piston rod of air cylinder 56 causes the gripper arms 58 and 60 to move away from each other until respective mutually opposing gripper pads on gripper arms 58 and 60 release the second section of the length of straight fastener tape.

With the stationary gripper assembly 8 open and the indexing gripper assembly 4 still gripping the first section of the length of fastener tape, the controller causes the servomotor 18 to drive the lead screw 16 to rotate a predetermined number of revolutions in a direction that moves the indexing gripper assembly 4 from its home position to an away or forward position. While the indexing gripper assembly 4 moves forward (leftward in FIG. 3), the length of fastener tape in its grip is pulled forward by a distance equal to the stroke of the carriage 12 traveling along the rail 10 (seen in FIGS. 2 and 4). The carriage stroke, in turn, is determined by the number of revolutions of the lead screw 16.

While the indexing gripper assembly 4 is in the away position and still gripping the first section of the length of fastener tape, the controller causes the double-acting air cylinder 56 (see FIG. 1) to extend its piston rod, again, e.g., by activating a solenoid that actuates a valve that connects the other of the two cylinder ports to a source of compressed air. Extending the piston rod causes the gripper arms 58 and 60 to move toward each other until the respective mutually opposing gripper pads on gripper arms 58 and 60 grip a third section of the length of straight fastener tape that is disposed ahead of the first section. When the stationary gripper assembly 8 grips the third section, the length of fastener tape is clamped and cannot be pulled forward or backward when the indexing gripper assembly releases the first section in the next step.

While the stationary gripper assembly 8 is gripping the third section of the length of fastener tape and the indexing gripper assembly 4 is in the away position, the controller causes the double-acting air cylinder 26 (see FIG. 2) to retract its piston rod, again, e.g., by activating a solenoid that, in turn, actuates a valve via which compressed air is supplied to the other of the two cylinder ports 36 and 38 (see FIG. 3). Retracting the piston rod causes the gripper arms 28 and 30 to move away each other until the respective mutually opposing gripper pads 32 and 34 release the first section of the length of straight fastener tape.

With the stationary gripper assembly 8 closed and the indexing gripper assembly 4 open, in the next phase of the work cycle the controller causes the servomotor 18 to drive the lead screw 16 to rotate the same predetermined number of revolutions, but this time in a direction that moves the indexing gripper assembly 4 from its away position back to its home position. While the indexing gripper assembly 4 moves rearward (rightward in FIG. 3), the length of fastener tape does not move, but rather is clamped in place by the stationary gripper assembly 8

The steps described in the preceding six paragraphs are then repeated for the next work cycle, starting with activating the indexing gripper assembly 4 to grip a fourth section of the length of fastener tape. The leading edge of the fourth section of the length of fastener tape will be located to the rear of the leading edge of the first section, separated by a distance equal to the return stroke of the carriage of the indexing gripper assembly. Each time the indexing gripper assembly, while gripping the length of fastener tape, travels from the home to the away position, the length of fastener tape will be pulled forward the same predetermined distance. That same predetermined distance typical corresponds to the width of a single package.

In accordance with one application, the fastener tape advancing apparatus depicted in FIG. 1 can be incorporated in a machine that unwinds continuous fastener tape from a reel or spool, inserts sliders onto the fastener tape at regular intervals (one slider per package length) and deforms the fastener tape at regular intervals to form a slider end stop structure (one slider end stop structure per package length). The ultrasonically stomped fastener tape with sliders mounted thereto is rewound on a take-up roll for storage or for transport to a packaging or bag machine.

Figure 5:
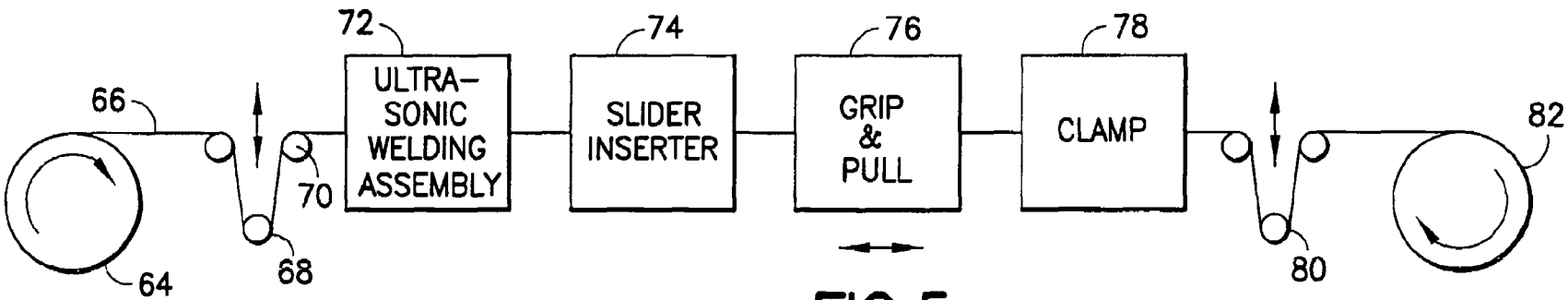
FIG. 5 is a block diagram representing automated fastener tape processing equipment for inserting sliders and forming slider end stop structures on a continuous fastener tape that is unwound and then rewound, the functions of the grip and pull unit and the clamp being performed by an apparatus of the type shown in FIG. 1.

One embodiment of a fastener tape processing machine of the type described in the preceding paragraph is generally depicted FIG. 5. A length of thermoplastic fastener tape 66, comprising, e.g., respective lengths of a pair of interlocked flanged zipper strips (e.g., of the slider-actuated type disclosed in U.S. Pat. No. 6,047,450), is unwound from a powered supply reel 64 and passed through a dancer assembly comprising a weighted dancer roller 68 that is supported on a shaft, which shaft is freely vertically displaceable (as indicated by the double-headed arrow in FIG. 5) along a slotted support column (not shown). The weight of the dancer roller 68 takes up any slack in the portion of fastener tape suspended between the supply reel 64 and the guide roll 70. A sensor may be provided for detecting the vertical position of the dancer roller 68. The feedback signal from that sensor is used by the PLC (described later with reference to FIG. 5) to control the motor that powers the supply reel 64, thereby controlling the payout of fastener tape 66.

An ultrasonic welding assembly 72 is disposed downstream of the guide roll 70. During each dwell time, the plastic zipper strips are softened (or melted) and shaped by the ultrasonic welding assembly in a respective zone. The ultrasonically welded plastic material of the respective zipper strips is shaped to form slider end stop structure in each zone upon cooling. The deformed portions of the zipper strips are also fused together in each zone. Each slider end stop structure will form back-to-back slider end stops when the end stop structure is cut during package formation. The ultrasonic welding assembly 72 may comprise an ultrasonic horn and an opposing anvil (not shown in FIG. 5). Either the horn or the anvil or both reciprocate between retracted and extended positions. While a portion of the fastener tape is being pressed between the horn and anvil, the horn is activated to transmit ultrasonic wave energy for softening and/or melting the thermoplastic fastener tape during each dwell time. The horn and/or anvil may be provided with recesses designed to form the softened and/or molten thermoplastic material into a slider end stop structure. When the softened/melted material cools, the material of the respective zipper strips fuses together to form a zipper joint.

The ultrasonically welded and shaped portion of fastener tape is then advanced to the next station, comprising a conventional slider insertion device 74 that inserts a respective slider onto each package-length section of fastener tape during each dwell time. Each slider is inserted adjacent a respective slider end stop structure on the continuous fastener tape. The slider insertion device comprises a reciprocating pusher that is alternately extended and retracted by an air cylinder (not shown in FIG. 5). As the pusher extends, it pushes the slider onto the fastener tape. The other parts of such a slider insertion device, including a track along which sliders are fed, are well known and will not be described in detail herein.

During each dwell time, the fastener tape is gripped by a clamp 88, so that the unwound length of fastener tape spanning the distance between guide roll 70 and clamp 78 is stationary during ultrasonic welding and slider insertion. The clamp 78 may comprise components that are functionally equivalent or similar to the components of the stationary gripper assembly previously described with reference to FIG. 1.

At the end of each dwell time, the fastener tape is gripped by a grip-and-pull mechanism 76 and then released by the clamp 78. Also, the ultrasonic horn or anvil or both are retracted and the pusher of the slider inserter is retracted, so that the length of fastener tape is free to advance except where the fastener tape is being gripped by the grip-and-pull mechanism 76. Then the grip-and-pull mechanism 76 is operated to pull the unwound length of fastener tape (ultrasonically stomped and carrying sliders) forward one package length. The most recently inserted slider leaves the slider insertion zone and the most recently formed slider end stop structure is moved from the ultrasonic welding station to the slider insertion zone. The clamp 78 is then closed again, following which the grip-and-pull mechanism is opened and returned to its home position. The grip-and-pull mechanism 76 may comprise components that are functionally equivalent or similar to the components of the indexing gripper assembly previously described with reference to FIGS. 1-4.

The length of ultrasonically stomped thermoplastic fastener tape with inserted sliders is then wound on a powered take-up reel 82 and passed through a dancer assembly comprising a weighted dancer roller 80 that is supported on a shaft, which shaft is freely vertically displaceable (as indicated by the double-headed arrow in FIG. 5) along a slotted support column (not shown). The weight of the dancer roller 80 takes up any slack in the portion of fastener tape suspended between the clamp 78 and the take-up reel 82. The reel 82, when full, is removed from the fastener tape processing machine and transported to a storage area or to a packaging or bag machine.

All of the foregoing automated steps performed by the apparatus depicted in FIG. 5 may be coordinated and synchronized by a conventional programmable logic controller (PLC) that has been suitably programmed. Programmed control of the apparatus depicted in FIG. 5 is schematically represented in the block diagram of FIG. 6 for the case wherein the clamp and the grip-and-pull mechanism comprise gripper assemblies of the type shown in FIG. 1.

Figure 6:
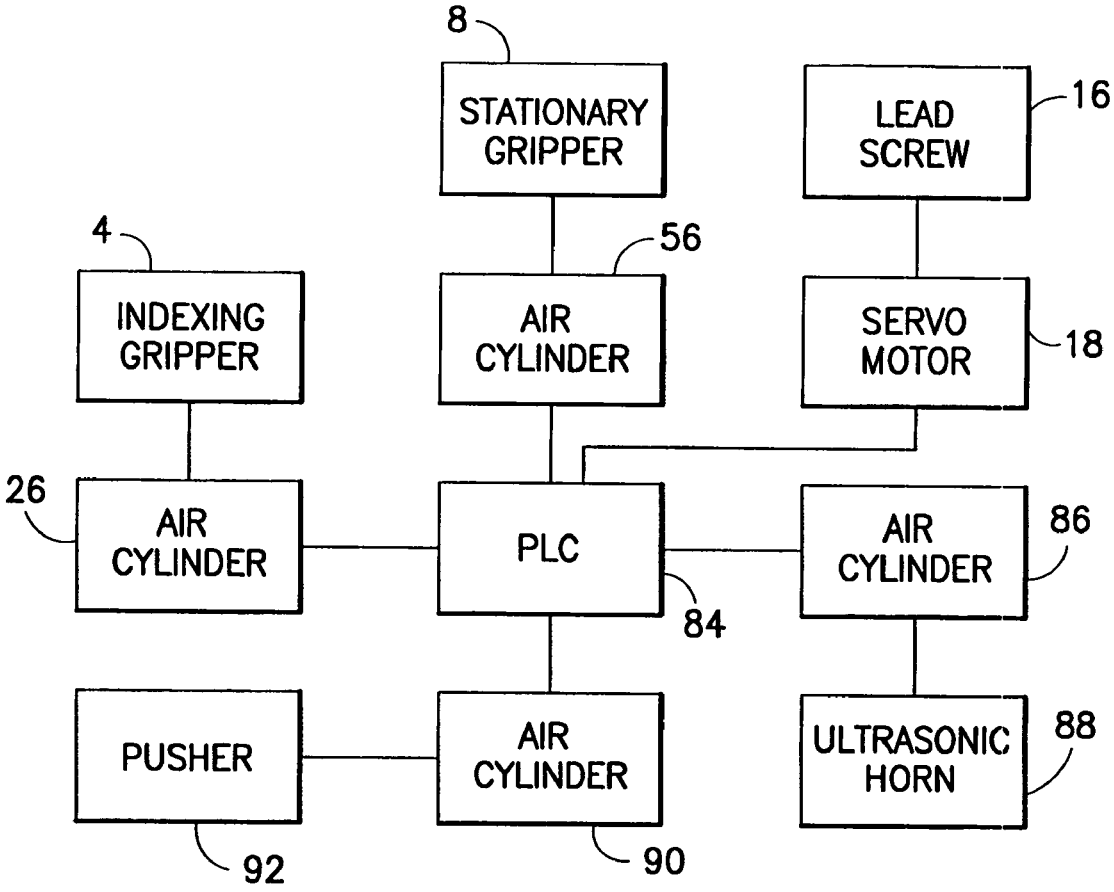
FIG. 6 is a block diagram representing a system for controlling the operation of various components of the machine depicted in FIG. 5.

Referring now to FIG. 6, a PLC 98 is programmed to control the various solenoids that open valves to connect a source of compressed air to various air cylinders 26, 56, 86 and 90, which in turn respectively actuate an indexing gripper assembly 4, a stationary gripper assembly 8, an ultrasonic horn 88 of an ultrasonic welding assembly, and a pusher 92 of a slider inserter. In addition, the PLC 98 controls a servomotor 18 that drives rotation of a lead screw 16, which rotation is converted into linear displacement of the indexing gripper assembly by means of the type previously described. The PLC 90 also controls a waveform generator (not shown) that supplies an electrical waveform to an ultrasonic transducer (not shown), which transducer in turn outputs acoustic waves that are delivered to the workpiece by the ultrasonic horn.

During a first phase of each work cycle, the PLC 98 causes the stationary gripper assembly 8 to close. During a second phase, the PLC causes the indexing gripper assembly 4 to open. While the stationary gripper assembly 8 is closed and the indexing gripper assembly 4 is open, the PLC sends control signals to the servomotor 18 that cause the lead screw 16 to rotate in a direction that retracts the indexing gripper assembly 4 from an away position to a home position. During this third phase of the work cycle, the PLC causes the air cylinder 86 to extend the activated ultrasonic horn 88 until it contacts the fastener tape and also causes the air cylinder 90 to extend the pusher 92 so that a slider is pushed onto the fastener tape. The duration of this third phase must be long enough to allow the ultrasonic stomping operation to be completed. During a fourth phase of the work cycle, the PLC 98 causes the indexing gripper assembly 4 to close and then causes the stationary gripper assembly 8 to open. The PLC also causes the horn 88 and the pusher 92 to retract. During a fifth phase of the work cycle, the PLC sends control signals to the servomotor 18 that cause the lead screw 16 to rotate in a direction that extends the closed indexing gripper assembly 4 from the home position to the away position, pulling the length of slider-carrying fastener tape forward one package length. Then the stationary gripper assembly 8 is again closed to start the next work cycle during which another slider will be inserted and another slider end stop structure will be formed. The PLC may also be programmed to control motors (not shown in FIG. 6) that drive the supply and take-up reels to rotate.

Hydraulic cylinders can be employed as actuators in place of air, i.e., pneumatic, cylinders. A person skilled in the art of machinery design will readily appreciate that displacing means other than a cylinder can be used to displace the various components, such as the horn of the ultrasonic welding assembly and the pusher of the slider inserter. For the sake of illustration, such mechanical displacement devices include rack and pinion arrangements or lead screw/coupling nut assemblies, rotation of the pinion or lead screw being driven by an electric motor.

The fastener tape advancing apparatus disclosed herein may also be used in conjunction with a packaging machine or a bag making machine. A second application of the present invention will now be described in which the slider-carrying fastener tape is advanced toward a bag making machine instead of a take-up reel, passing through a drag sealer on its way to the bag making machine. The drag sealer (described in detail later with reference to FIG. 8) joins the fastener tape to a folded web of packaging material and the bag machine then cross seals the tape/web assembly to form pockets, fills the pockets with product and severs the filled pockets to form individual packages in conventional fashion.

Figure 7:
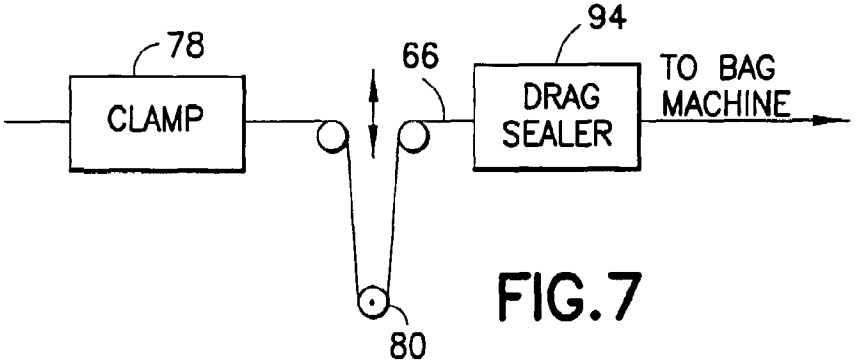
FIG. 7 is a block diagram showing processed fastener tape being fed to a drag sealer for joinder to a web of packaging, the fastener tape being processed by components 72 and 74 depicted in FIG. 5.

One embodiment of a system of the type described in the preceding paragraph is shown in part in FIG. 7. FIG. 7 shows fastener tape 66 that passes, in sequence, through a clamp 78, an accumulator 80 and a drag sealer 94, on its way to a bag making machine (not shown). The components upstream of the clamp 78 are the same as those previously described with reference to FIG. 5 and are not shown in FIG. 7 to avoid redundancy, i.e., the upstream components include a motorized supply reel 64, an ultrasonic welding assembly 72, a slider inserter 74 and a grip-and-pull mechanism 76.

Again, all operations of the components mentioned in the preceding paragraph may be controlled by a PLC, as previously described with reference to FIG. 6. In one implementation, the PLC controls the aforementioned components as a function of feedback received from a photodetector or optical eye that detects, in the area of the drag sealer, the passage of indexing markings on the continuously advancing web of packaging material. Such optical sensor feedback is described in detail in U.S. Pat. No. 7,172,545.

Still referring to FIG. 7, the length of unwound fastener tape 66, with sliders inserted thereon then travels through a dancer assembly on its way to a drag sealer 94, where the fastener tape will be joined to the sides of a folded web of packaging material in conventional fashion, as will be described later with reference to FIG. 8. The dancer assembly comprises a weighted dancer roller 80 that is supported on a shaft, which shaft is freely vertically displaceable (as indicated by the double-headed arrow in FIG. 7) along a slotted support column (not shown). The weight of the dancer roller 80 takes up any slack in the fastener tape.

In accordance with the embodiment partly depicted in FIG. 5 and partly depicted in FIG. 7, the tape and web are advancing continuously through the drag sealer 94 at a constant speed, whereby incremental portions of the slider-carrying fastener tape are joined to respective incremental portions of the web. This process of joining the fastener tape to the web of packaging material occurs continuously during each of a succession of work cycles. Each work cycle, however, is distinguished by two phases: a dwell time during which the clamp 78 is closed and the portion of the fastener tape upstream of the clamp is not advancing; and an intermittent advancement phase during which the clamp is open. When the clamp 78 is open, the grip-and-pull mechanism (item 76 in FIG. 5) advances the gripped portion of the fastener tape intermittently at a speed greater than the speed at which the joined tape and web are moving through the drag sealer 94. The dancer assembly accumulates fastener tape as the tape arrives at a rate faster than the rate at which tape leaves. Later, when the fastener tape is clamped by the clamp 78, the continuously advancing joined tape and web pull the accumulated portion of the fastener tape behind it, the latter following the former through the drag sealer 94. This work cycle is repeated during machine operation.

Figure 8:
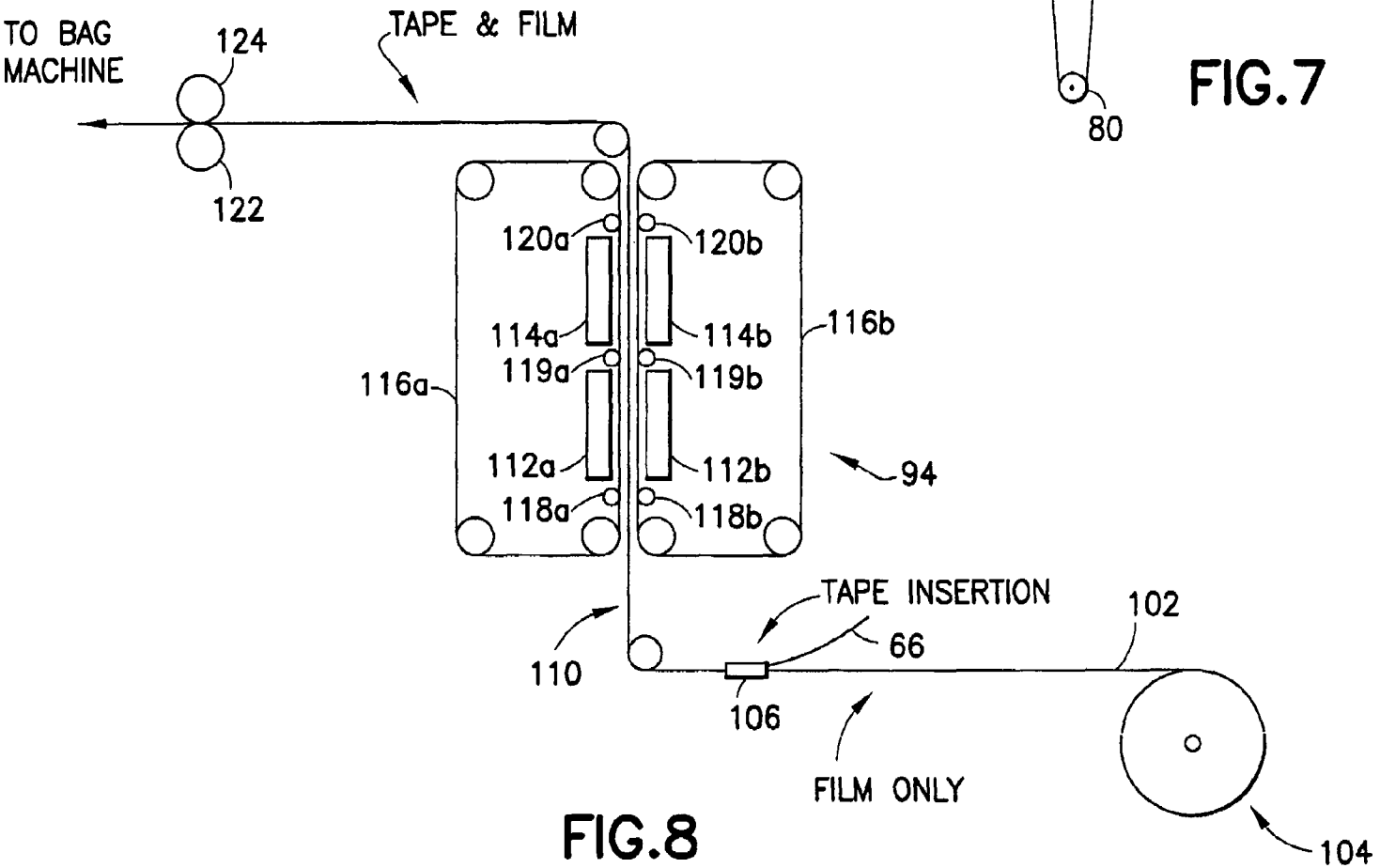
FIG. 8 is a drawing showing the structure of a conventional drag sealer of a type that can be fed with fastener tape by the apparatus depicted in FIG. 7.

FIG. 8 shows a drag sealer that works in conjunction with a bag making machine. A pre-folded web 102 of bag making film is paid out from a supply roll 104 and a fastener tape 66 is inserted between the walls of the folded web by a tape inserter 106. The fastener tape and folded web are then threaded through the drag sealer 94 and a pair of motor-driven pinch rolls 122 and 124. Typically the pinch rolls 122 and 124, which pull the film 102 through the drag sealer 94, are part of the bag making machine. As an alternative to paying out a pre-folded web 102 of bag making film, film that is not folded can be wound on supply roll 104. In this case, a conventional folding board or plow (not shown in FIG. 8) would be installed between the roll 104 and the tape inserter 106.

After passing through the accumulator (shown in FIG. 7), the fastener tape is guided into position between the folded web by the tape inserter 106, which comprises a channel having a cross-sectional profile shaped to maintain the orientation of the slider-carrying fastener tape 66 as it is fed toward the folded web 102. The outlet end of the tape inserter 106 is designed to separate the opposing edges of the folded web by a sufficient distance to allow the emerging fastener tape 66 to be inserted therebetween and in parallel with the opposing edges. Sets of opposing guide rollers may be provided at any points downstream of the tape inserter to maintain the position of the inserted fastener tape 66 in parallel with and sandwiched between the opposing walls of the folded web 102.

The folded web 102 and the fastener tape 66 are then advanced together (indicated by numeral 110 in FIG. 8) through the drag sealer 94, which is shown as being a vertical sealing apparatus comprising a first pair of mutually opposing heated sealing bars 112*a*and 112*b*and a second pair of mutually opposing heated sealing bars 114*a*and 114*b*. The sealing bars 112*a*and 112*b*are displaceable away from each other, as are the sealing bars 114a and 114*b*. Sealing of the fastener tape to the folded web of bag making film occurs while the sealing bars are in their respective extended (toward each other) positions. The sealing bars are retracted (away from each other) as needed, e.g., during threading of the web and tape through the sealing apparatus prior to startup.

As the folded web 102 with inserted fastener tape 66 advances vertically and continuously between the opposing sets of sealing bars, the respective zipper flanges of the fastener tape are sealed to the opposing edges of the bag making film, thereby continuously attaching incoming sections of the moving fastener tape to adjoining sections of the moving web. The sealing is accomplished by electrically heating the sealing bars, the heat being conducted through respective endless barrier strips 116*a* and 116*b* made of Teflon or similar material, which circulate on respective sets of rollers. Teflon barrier strip 116*a* passes between one side of the folded web and the sealing bars 112*a* and 114*a*, while Teflon barrier strip 116*b* passes between the other side of the folded web and the sealing bars 112*b* and 114*b*. In the gaps between the opposing sealing bars, the web and fastener tape are sandwiched between and held together by the Teflon barrier strips 116*a* and 116*b*, which move with the web and fastener tape and prevent the bag making film from sticking against the stationary heated sealing bars during conduction heat sealing. The Teflon barrier strips and intervening web and fastener tape pass through the nips of a series of guide rollers respectively positioned in advance of the sealing bars (guide rollers 118*a* and 118*b*); in between the sealing bars (guide rollers 119*a* and 119*b*); and after the sealing bars (guide rollers 120*a* and 120*b*). It should be appreciated that for the sake of illustration, the Teflon barrier strips, the folded web and the sealing bars are shown in FIG. 8 with respective gaps between adjoining components, whereas in reality these components are in contact with each other when the sealing bars are in their extended positions. Likewise the nips formed by the opposing pairs of guide rollers have been shown in the drawing with gaps, when in actuality the Teflon barrier strips and the web with inserted fastener tape are pressed together in the nips and no gaps occur. The Teflon barrier strips 116*a* and 116*b* and the guide rollers 118*a*, 118*b*, 119*a*, 119*b*, 120*a* and 120*b* are disposed in the area of the fastener tape and do not extend the full height (i.e., the dimension transverse to the fastener tape) of the folded bag making film.

Although the implementation shown in FIG. 8 has two sealing bars arranged in series on each side of the traveling web and fastener tape, any number of sealing bars can be used provided that sufficient heat is conducted into the fastener tape to cause the zipper flanges to seal to the bag making film.

Typically each sealing bar assembly (not shown in FIG. 8) comprises a seal bar core, a seal bar cap having a sealing bar projecting therefrom, an insulator, and another seal bar cap separated from the seal bar core by the insulator. The seal bar cap is fastened to the ends of threaded rods. The seal bar core has a pair of longitudinal channels that respectively house a thermocouple and an electric heater, both of which are electrically connected to a programmable heat controller by electrical wiring (neither of which are shown in FIG. 8). The thermocouple produces electrical signals representing the temperature of the seal bar core, which signals are received by the heat controller. The heat controller controls the level of electrical current supplied to the heater in accordance with a heat control program that is designed to maintain the sealing bar temperature within limits preset by the system operator. In particular, the temperature of the sealing bar must be selected such that the amount of heat conducted through the bag making film and into the adjoining zipper flange, during the time that the zipper flanges and film are pressed between the extended sealing bars, will achieve the desired result, namely, sealing of the zipper flange to the bag making film without "seal-through" of the zipper flanges, i.e., sealing of the zipper flanges to each other. The zipper flanges may be laminated with high-melting-point thermoplastic material on their confronting sides to prevent "seal-through" of the zipper flanges.

The fastener tape and folded web that enter the sealing station unjoined, exit the sealing station joined together by permanent seals. The pinch rolls 122 and 124 (which form part of the bag making machine) continue to pull the joined fastener tape and web forward.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. An apparatus comprising:

an ultrasonic welding assembly;

a slider inserter;

a fixed support frame comprising a straight rail;

an indexing gripper assembly that is slidably mounted to said rail for linear motion therealong, wherein said indexing gripper assembly comprises linked mutually opposed grooved first and second gripper arms that move toward each other during a gripping operation and move away from each other during a release operation;

a stationary gripper assembly that is mounted to said support frame, wherein said stationary gripper assembly comprises linked mutually opposed grooved third and fourth gripper arms that move toward each other during a gripping operation and move away from each other during a release operation;

an indexing drive mechanism for causing said indexing gripper assembly to displace linearly between first and second positions along said rail, said second position being closer to said stationary gripper assembly than said first position is; and a controller programmed to control said indexing and said stationary gripper assemblies and said indexing drive mechanism so that the following events occur in the order listed:

(a) said indexing gripper assembly is actuated so that said first and second gripper arms grip a first section of a length of fastener tape that is substantially straight while said indexing gripper assembly is in said first position;

(b) while said first and second gripper arms are gripping said first section and said third and fourth gripper arms are not gripping any section of said length of fastener tape, said indexing drive mechanism is actuated to move said indexing gripper assembly from said first to said second position;

(c) while said indexing gripper assembly is in said second position and said first and second gripper arms are gripping said first section of said length of fastener tape, said stationary gripper assembly is actuated so that said third and fourth gripper arms grip a second section of said length of fastener tape that is disposed ahead of said first section;

(d) while said third and fourth gripper arms are gripping said second section of said length of fastener tape and said indexing gripper assembly is in said second position, said indexing gripper assembly is actuated so that said first and second gripper arms release said first section of said length of fastener tape; and (e) while said third and fourth gripper arms are gripping said second section and said first and second gripper arms are not gripping any section of said length of fastener tape, said indexing drive mechanism is actuated to move said indexing gripper assembly from said second to said first position, and wherein said controller is further programmed to control said ultrasonic welding assembly to deform a third section of said length of fastener tape and to control said slider inserter to insert a slider onto a fourth section of said length of fastener tape while said third and fourth gripper arms are gripping said second section; and wherein said fastener tape comprises a pair of extruded flanged zipper strips having mutually interlockable closure profiles that are received between the grooves of said first and second grooved gripper arms.

2. The apparatus as recited in claim 1, wherein said controller is further programmed so that the following events occur after events (a) through (e):

(f) said indexing gripper assembly is actuated so that said first and second gripper arms grip a third section of said length of fastener tape while said indexing gripper assembly is in said first position and while said third and fourth gripper arms are gripping said second section of said length of fastener tape; and (g) while said indexing gripper assembly is in said first position and said first and second gripper arms are gripping said third section of said length of fastener tape, said stationary gripper assembly is actuated so that said third and fourth gripper arms release said second section of said length of fastener tape.

3. The apparatus as recited in claim 1, wherein said indexing gripper assembly further comprises a first double-acting air cylinder that actuates said first and second gripper arms to move, and said stationary gripper assembly further comprises a second double-acting air cylinder that actuates said third and fourth gripper arms to move, the state of said first and second double-acting air cylinders being controlled by said controller.

4. The apparatus as recited in claim 1, wherein said indexing gripper assembly further comprises a carriage that rides on said rail, said first double-acting air cylinder and said first and second gripper arms being carried by said carriage.

5. The apparatus as recited in claim 4, wherein said indexing drive mechanism comprises a lead screw and a nut threadably coupled to said lead screw, said nut being rigidly coupled to said carriage.

6. The apparatus as recited in claim 1, wherein said indexing drive mechanism comprises a lead screw and a nut threadably coupled to said lead screw, said nut being rigidly coupled to said indexing gripper assembly.

7. The apparatus as recited in claim 6, wherein said indexing drive mechanism further comprises a servomotor that actuates said lead screw to rotate, the state of said servomotor being controlled by said controller.

8. The apparatus as recited in claim 1, further comprising a fastener application station where said length of fastener tape is attached to a web of packaging material.

* * * * *